United States Patent [19]

King

[11] 4,197,605

[45] Apr. 15, 1980

[54] GLAZING TOOL

[76] Inventor: Danny L. King, 618 S. Driftwood, Santa Ana, Calif. 92704

[21] Appl. No.: 953,470

[22] Filed: Oct. 23, 1978

[51] Int. Cl.[2] ..... E04F 21/28; B26B 11/00

[52] U.S. Cl. ..... 7/105; 7/158

[58] Field of Search ..... 7/105, 127, 158; 30/191

[56] References Cited

U.S. PATENT DOCUMENTS

| | | | |
|---|---|---|---|
| 1,156,783 | 10/1915 | Kane | 7/105 |
| 1,693,745 | 12/1928 | Connor | 7/105 X |
| 2,487,291 | 11/1949 | Abruzzese | 7/105 |

FOREIGN PATENT DOCUMENTS

| | | | |
|---|---|---|---|
| 546468 | 2/1977 | U.S.S.R. | 7/105 |

*Primary Examiner*—James G. Smith
*Attorney, Agent, or Firm*—Ben E. Lofstedt

[57] ABSTRACT

An improved glazing tool including a manually operable cutting device, of a scissors-type variety, having a pair of arms mediately secured to one another by a pin for permitting pivotal movement therebetween, on one side of the pin the arms having face-to-face complementary cutting edges thereon and on the other side of the pin a pair of handles permitting manual operation thereof, one of said arms being longer than the other arm, the forwardmost portion of the longer arm having a hub with a small roller freely mounted thereon, and the opposite end of the longer arm extending rearwardly beyond the other arm forming a handle and terminating in a flat blade.

5 Claims, 3 Drawing Figures

GLAZING TOOL

BACKGROUND OF THE INVENTION

1. Field of the Invention

This invention relates to, in general, glazing tools, and, more particularly, to a manual tool for installing and removing the eastomeric gasket used to effect a fluid seal about a window installed in a metallic frame.

2. Description of the Prior Art

Installation or removal of window glass into metal framed sashes, typically aluminum, includes installation or removal of an elastomeric gasket for effectuating a fluid seal between the window glass and the window frame. Such gasket material is shipped in the form of long continuous strips rolled on a spool of material.

After the window glass is set in the metal frame, the continuous gasket material is forced in between the metal frame and the window glass.

To effect such an installation, a continuous strip of gasket material is measured to a near fit with the window frame and cut from the rest of the continuous strip on the spool with a knife or a compression cutting tool, such as diagonals, or a scissors-type tool, such as shears or snips. Generally, compression cutting tools are preferred because this tool is less hazardous to use because of the reduced risk of cutting the operator, and it is easier to cut a straight edge thereacross.

Thereafterwards, the gasket material is poked or jammed inbetween the window frame and the window glass with the end of a flat-blade tool to start the gasket in its fluid sealing position.

Once the gasket material is started, the balance of the gasket is forced therebetween by the use of a rolling wheel mounted on a handle.

Removal of the gasket material is accomplished by plunging the flat blade between the metal window frame and the gasket and prying up an edge of the gasket and pulling it out the rest of the way. Once this occurs, the balance of the gasket material is removed by pulling the strip from its compression fitted fluid sealing position.

As can readily be seen, the prior art installation and removal technique required the use of at least three separate tools.

The use of three separate tools is not only time-consuming but expensive.

If one tool should be misplaced, the procedure cannot be accomplished.

Glazers are paid on a per window installation basis. Time, therefore, is money. It is to this end that the present device was invented so that the above-mentioned problems could be overcome.

SUMMARY OF THE INVENTION

Fundamentally, the present invention is an improved glazing tool for installing and removing windows from window frames. This tool includes a manually operable cutting device, of a scissors-type variety, having a pair of arms mediately secured to one another by a pin for permitting pivotal movement therebetween, on one side of the pin the arms having face-to-face complementary cutting edges thereon and on the other side of the pin, a pair of handles permitting manual operation thereof, one of said arms being longer than the other arm, the forwardmost portion of the longer arm having a hub with a small roller freely mounted thereon, and the opposite end of the longer arm extending rearwardly beyond the other arm forming a handle and terminating in a flat blade.

OBJECTS OF THE INVENTION

It is an object of the present invention to provide a combination glazer's tool which eliminates the need for separate tools for the installation or removal of the fluid sealing gasket mounted between the window pane and the window frame.

It is yet a further object of the instant invention to provide an improved glazer's tool which permits the rapid installation or removal of gasket material from between the window pane and the window frame.

Another important and primary object of the invention is to provide a glazer's tool which increases the speed for installing and removing the gasket material about a window.

A yet still further and important object of the present invention is to provide a glazer's tool which improves substantially the productivity of the glazer.

Another important and primary object of the invention disclosed herein is to provide a glazer's tool which is more compact that those of the prior art.

A further object of the present invention is to provide a new glazer's tool which is less hazardous to use than those comprising the prior art devices.

The various features of novelty which characterize this invention are pointed out with particularity in the claims annexed to and forming a part of this specification.

For a better understanding of the invention, however, its advantages, and specific objects of its use, reference should be had to the accompanying drawings and descriptive matter in which have been illustrated and described the preferred embodiments of the invention.

In the drawings:

DESCRIPTION OF THE PREFERRED EMBODIMENT OF THE INVENTION

Figures 1, 2, 3:
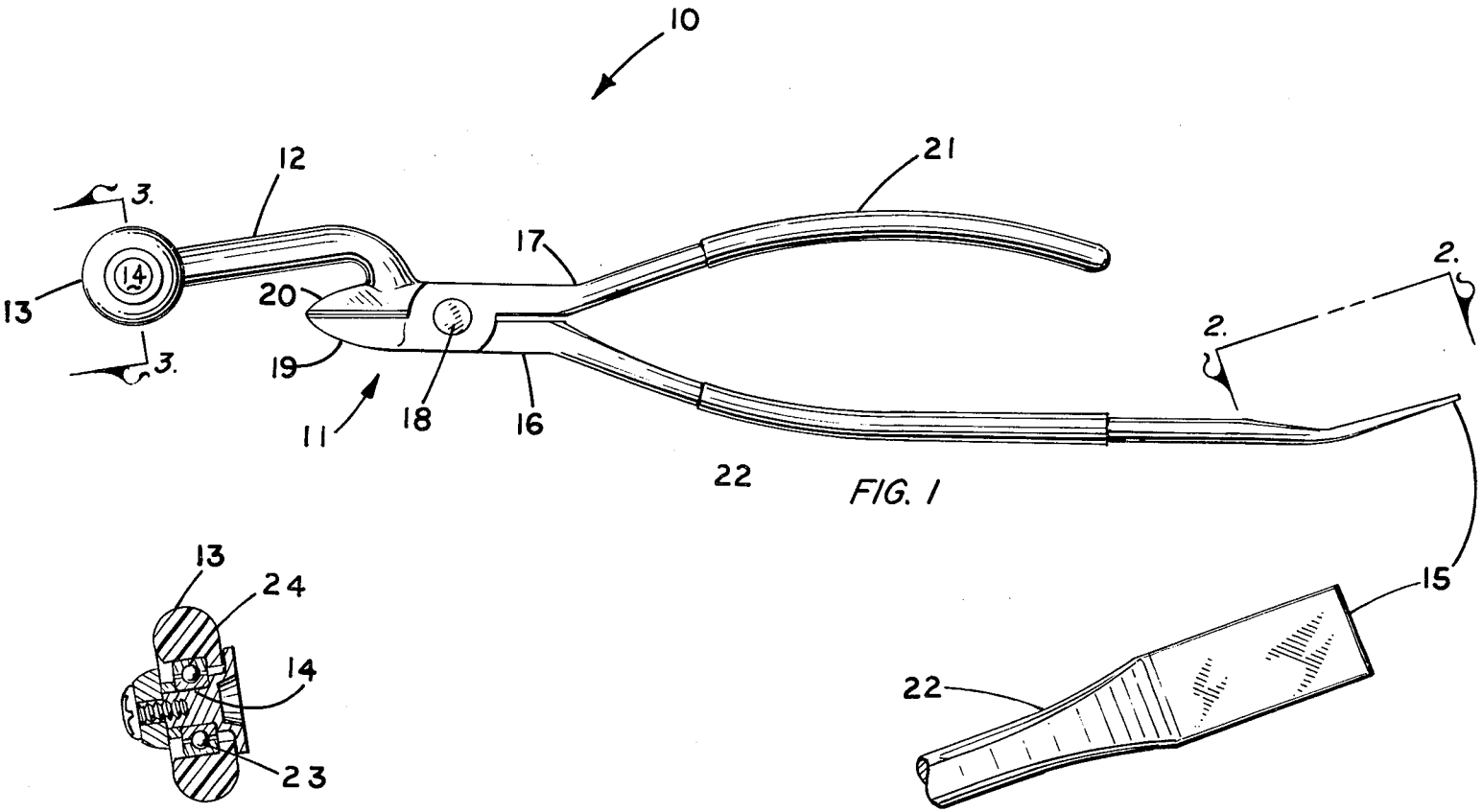
FIG. 1 is a side elevational view of the invention.
FIG. 2 is a view of a portion of the invention taken along Plane 2—2 of the view shown in FIG. 1.
FIG. 3 is a view of a portion of the invention taken along Plane 3—3 of the view shown in FIG. 1.

Prior to launching into a detailed and informative disclosure of the preferred embodiments envisioned for the present invention, it is to be clearly understood that the instant invention is not limited in any way in its application, to the details of construction and arrangement of parts illustrated in the accompanying drawings, since the subject invention is readily capable of other embodiments and of being practiced or carried out in various and diverse ways.

It should be further understood that the particular phraseology or terminology employed herein is merely for the sole purpose of description and is not intended to be limiting in any way, form or fashion.

With continued reference to the drawings, the improved glazer's tool is generally designated at 10. Fundamentally, the present invention is an improved glazing tool 10 for installing or removing fluid sealing gaskets from between window panes and window frames. The improved glazer's tool 10 comprises a manually operable cutting device, generally indicated at 11, a forwardmost arm 12 projecting from the cutting device 11 with a rotatable wheel 13 mounted in a hub 14 in the arm 12, and a flat blade 15 projecting rearwardly from the cutting device 11.

With particular emphasis now on FIG. 1, the improved glazing tool 10 includes a manually operable cutting device 11 having a pair of arms 16, 17 mediately secured to one another by a pin 18. The pin 18 permits pivotal movement therebetween. On one side of the pin 18, the arms 16, 17 have a complementary, face-to-face pair of diagonally cut, cutting jaws 19, 20. Such cutting jaws 19, 20 are used for compressional cutting of wire, strands of gasket material, such as the window sealing gasket material formed of elastomeric material such as described herein, rope, and the like.

However, it should be noted, at this time, that such cutting jaws 19, 20 are not the only kind of cutting jaws which may be employed by the invention forming the device herein disclosed. Such cutting jaws as are employed in scissors, snips, and shears may be used interchangeably. However, it is the opinion of the inventor herein that the compressional cutting jaws 19, 20 are the most desirable for the use herein described.

On the other side of the pin 18 of the arms 16, 17, the arms 16, 17 have portions thereon designated and functionally employed herein as handles 21, 22 for manual operation of the cutting jaws 19, 20. Operationally speaking, as the handles 21, 22 are moved away from each other, the cutting jaws 19, 20 correspondingly move away from each other to permit the material to be cut, here the gasket material, to be inserted therebetween.

One of the arms, herein identified as arm 16, is longer than the other arm 17. The longer arm 16 has two functionally distinct additional portions; namely, a forwardmost arm 12 and a rearwardmost projecting flat blade 15. The purposes and functions of these portions will be further described hereinafterwards in greater depth and detail.

The forwardmost arm 12 further contains a hub 14 in its furthermost forward portion wherein a freely rotatable wheel 13 is secured. For best operation, the wheel should have ball bearings 23 mounted therein for durable, smooth and rapid operation. The ball bearings 23 and the race 24 in which such are mounted are detailed in FIG. 3 of the drawings.

The rearwardmost portion of the arm 16 contains a flat blade 15, which is detailed in FIG. 3.

OPERATION OF THE INVENTION

After the window glass is placed in the metal frame, a strip of elastomeric gasket material is unrolled from a spool containing a continuous strip of the gasket material.

The glazer then estimates the length of the gasket material needed, and cuts the approximate length needed using the compression cutting jaws 19, 20 of the improved glazer's tool 10.

The cut strip of gasket material is then driven inbetween the window pane and the window frame by the use and assistance of the flat blade 15 of the improved glazer's tool 10. Once this wedging action is completed, the improved glazer's tool 10 is turned over in the glazer's hand and the wheel 13 is impressed, forceably, against the gasket material wedged therebetween the window pane and the window frame as described hereinabove. The wheel 13 is then directed to move over the non-wedged gasket material as it is played out and guided by the glazer's free hand into alignment between the window pane and the window frame so as to drive the gasket wedgingly therebetween in a continuous fashion. Once the gasket material is installed, a continuous fluid seal is effectuated between the window pane and the window frame.

In order to remove the gasket, the edge of the flat blade 15 is driven inbetween the window frame and the gasket material and thereafterwards used to pry out the gasket material without permanently damaging same. Once a portion of the gasket material is so removed, the balance is unwedged by pulling outwardly on the free portion of the gasket until it is entirely removed.

While this particular invention has been shown and described in particular arrangements merely for illustration and explanation, it will be readily apparent that the invention may be widely varied without departing from the scope and spirit of this invention.

For example, it will be readily apparent that the blade 15 could be mounted on the arm 17 without departing from its use and function as hereinbefore previously described and disclosed. Further, it should be readily understood and appreciated that the forwardmost arm 12 with the rotatable wheel 13 thereon could be fixedly secured to the other arm 17 rather than arm 16 without departing from the spirit and scope of the invention disclosed herein.

What I claim is:

1. A hand tool, comprising: a pair of arms mediately secured to one another by a pin for permitting pivotal movement therebetween, that portion of the arms located on one side of the pin having a pair of cooperatively associated cutting edges forming the forward portion of the tool, and that portion of the arms located on the other side of the pin forming a pair of handles which, when moved towards each other, correspondingly bring the cutting edges together into cutting relationship, one of the arms being longer in length than the other arm, the forwardmost portion of the longer arm having a hub with a small roller freely mounted thereon, and the opposite end of the longer arm beyond the handle portion thereof terminating in a flat blade shaped portion.

2. The hand tool of claim 1 wherein said pair of handles are arcuately shaped.

3. The hand tool of claim 1 wherein said cutting edges are compression type cutting edges wherein said cutting edges are alignably disposed in face-to-face relationship and cutting is achieved by placing the material to be cut therebetween, manually squeezing the handles together thereby bringing the cutting edges together to compressionally severe the material therebetween.

4. The hand tool of claim 1 wherein said roller is a Nylon roller.

5. The hand tool of claim 1 wherein said wheel includes a ball-bearing race therein.

* * * * *